United States Patent [19]

Peng

[11] Patent Number: 4,951,948

[45] Date of Patent: Aug. 28, 1990

[54] SHOCK ABSORBING BAT

[76] Inventor: Jung C. Peng, 11, Lane 10, Da Rong East Street, Taichung, Taiwan

[21] Appl. No.: 338,780

[22] Filed: Apr. 17, 1989

[51] Int. Cl.[5] ..... A63B 59/06

[52] U.S. Cl. ..... 273/72 R; 273/72 A; 273/26 B; 267/136

[58] Field of Search ..... 273/67 R, 67 D, 67 DA, 273/72 R, 72 A, 80 B, 80.4, 73 J, 73 C; 267/136, 137; 272/124

[56] References Cited

U.S. PATENT DOCUMENTS

| | | | |
|---|---|---|---|
| 537,927 | 4/1895 | Kennedy | 273/32 R |
| 2,772,887 | 12/1956 | Blake | 273/26 B |
| 3,116,926 | 1/1964 | Owen et al. | 273/72 R |
| 3,173,688 | 3/1965 | Green | 273/72 R |
| 3,508,748 | 4/1970 | Strimel | 273/72 R |
| 3,516,669 | 6/1970 | Gray | 273/72 R |
| 3,877,698 | 4/1975 | Volpe | 273/72 R |
| 4,274,631 | 6/1981 | Hayazaki | 273/26 B |
| 4,399,996 | 8/1983 | Boyce | 273/26 B |
| 4,660,832 | 4/1987 | Shomo | 273/73 J |
| 4,772,021 | 9/1988 | Maynard | 273/73 C |

*Primary Examiner*—Edward M. Coven
*Assistant Examiner*—Mark S. Graham

[57] ABSTRACT

A shock absorbing bat comprises a long cylindrical central handle and a main body, both being connected together and held firmly by means of a retaining collar and an elastic ring. An elastic connector is provided which is axially attached to an end piece. This construction can drastically reduce the shock to the batter's arm and the possibility of injury to the elbow is minimized. The construction also increases the impulse, when a ball is struck.

15 Claims, 4 Drawing Sheets

SHOCK ABSORBING BAT

BACKGROUND OF THE INVENTION

1. Field of the Invention

The present invention relates to sport bats, and in particular relates to the specific structure of a bat that not only largely reduces the violent shock which may cause injury to a batter's elbow, but also increases the explosive power imparted to the ball.

2. Description of Background Art

Sports have been so popular in the United States of America, and most Americans are fascinated by sports. Some individuals even make a career playing for a professional team, for example, baseball. The equipment of baseball include bases, gloves, helmets, balls and baseball bats; especially the bats in which quality is the key point of winning or losing. Moreover sport injuries due to a low quality bat may easily ruin a professional player's career. Presently, baseball bats are made of wood, aluminum, graphite reinforced plastic and the like. No matter what material or manner which is used for construction or whether solid or hollow, single piece constructed or glue-laminated constructed, the structure is basically the same, i.e., the striking area of a baseball bat is directly connected with the handle area of a baseball bat.

When a pitcher throws a ball, usually the minimum speed is 80 kilometers per hour. And 160 kilometers is not the limit of a professional pitcher. So, when a batter hits the ball, the instantaneous shock of the collision is directly transmitted to the part that the batter holds. It is no wonder that sport injuries happen so easily. Some bats may be made of shock-absorbing materials; somehow the striking area and the handle area are directly connected together, in short, it is simply "a" baseball bat. Even if said batter wears a sweat band, it is nothing but a stopgap measure, it does not have any effect. Up to now, there are no bats that can adequately protect baseball players, without ever mentioning the bats that also increase the power delivered to the ball.

SUMMARY OF THE INVENTION

The main object of the invention is to provide a shock-absorbing bat which can drastically absorb the resultant shock from striking a ball so as to prevent possible injuries to the elbow.

Another object of the present invention is to increase the impulse imparted to the ball with regard to speed and distance traveled.

According to the present invention, the shock absorbing bat comprises a long cylindrical central handle and a main body, both being connected together and held firmly by means of a retaining collar and an elastic ring. An elastic connector is also axially attached to an end piece, and thus this construction can drastically reduce the shock to the batter's arm and the possibility of injury to the elbow is minimized. The construction also increases the impulse, when a ball is struck.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
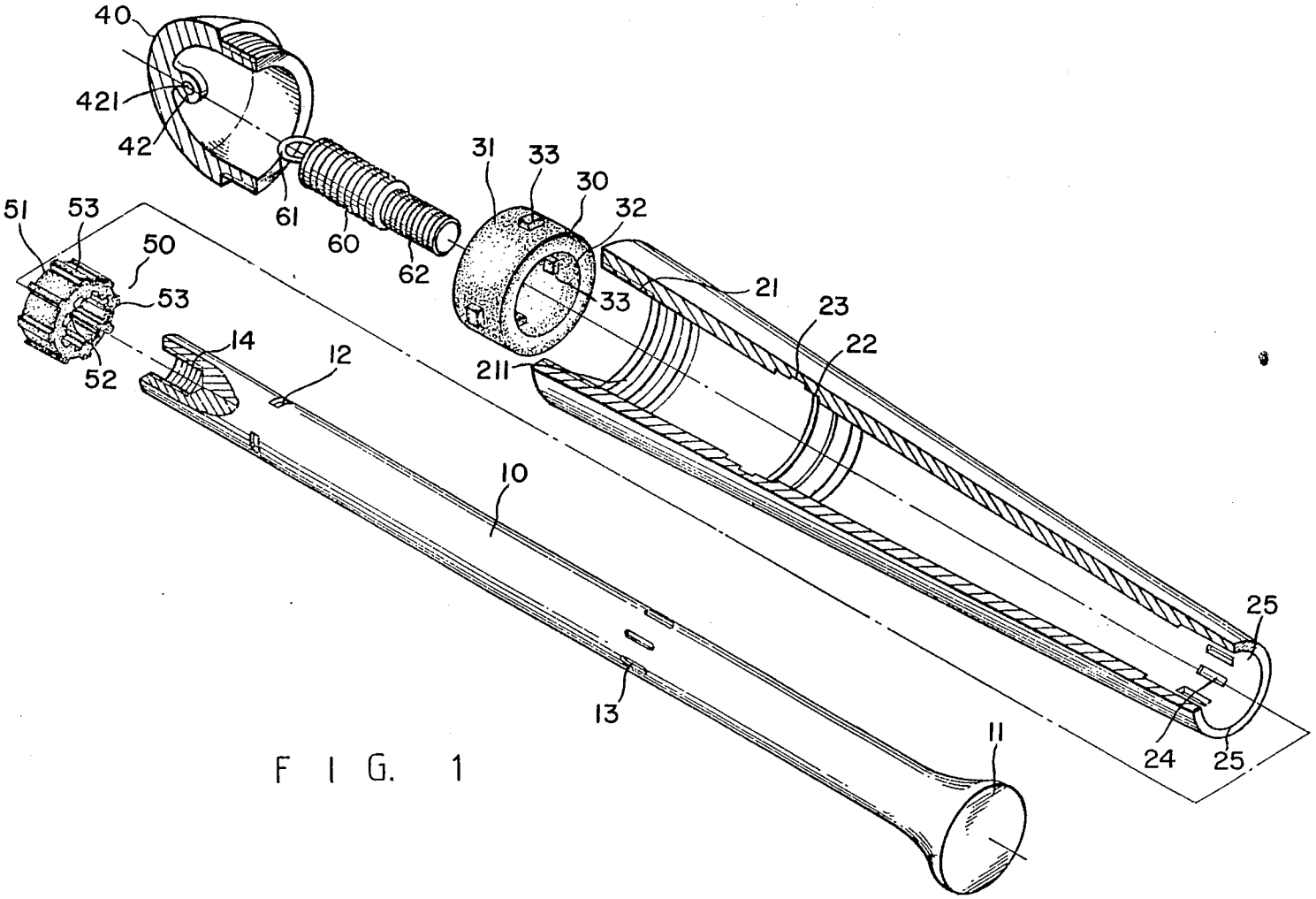
FIG. 1 is a perspective fragmentary view of a shock absorbing and impulse increasing bat embodying the present invention.
Figure 2:
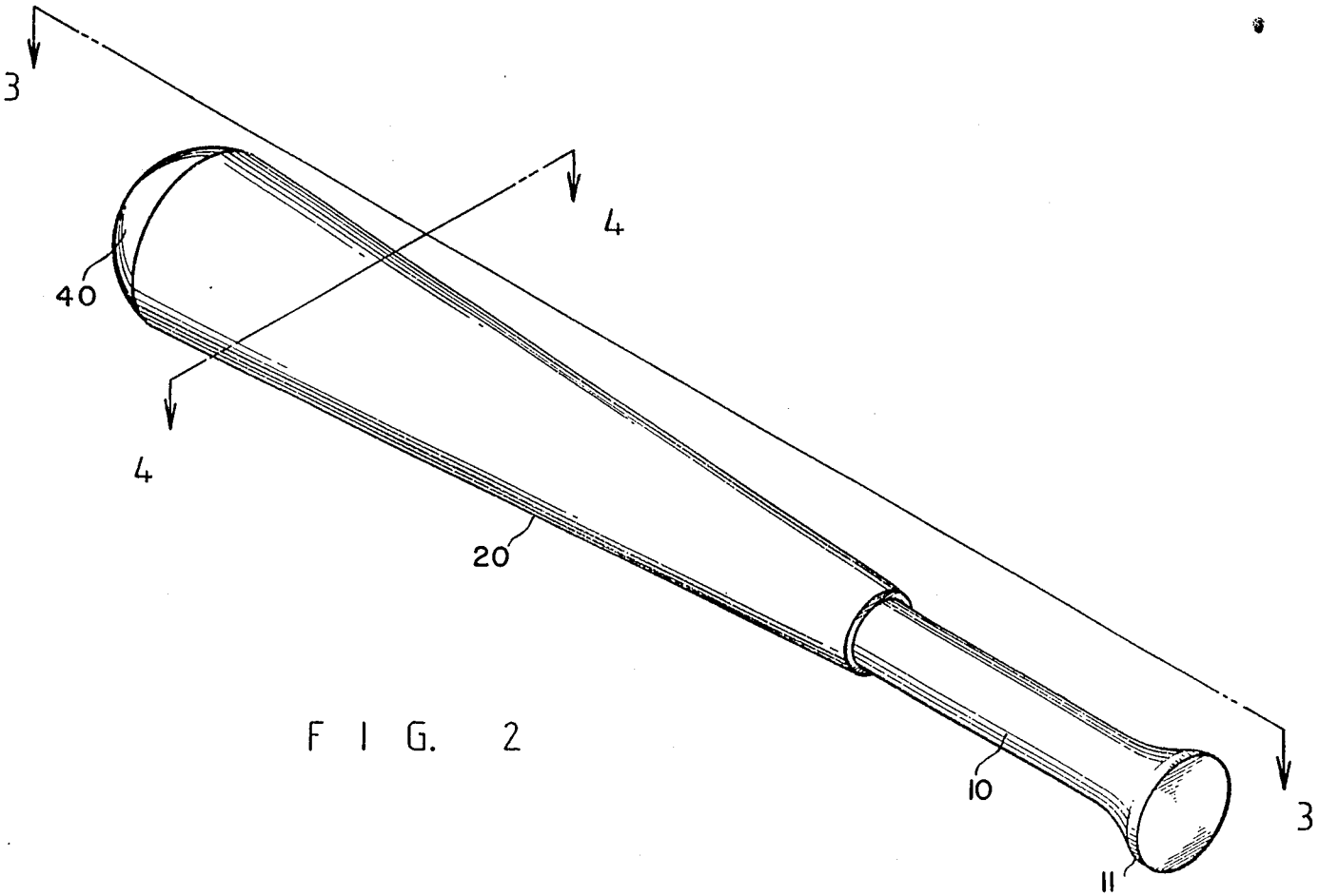
FIG. 2 is a perspective assembly view of said embodiment of the present invention.

Referring to FIGS. 1 and 2, a shock absorbing bat, according to the present embodiment is a baseball bat which includes a long cylindrical central handle (10) with an end piece (40). A female threaded recess of predetermined depth is provided in the handle (10). The end of said handle opposite from the end with the threaded recess enlarges to form a knob-shaped hand guard(11) which purpose is to prevent the batter's hand from slipping off the end. Located at set positions on said handle are several shallow recesses(13) set at equal distances along the circumference of said handle and paralleled to the central axis of said handle. Located at set positions on said end piece are several rectangular recesses(12) which are set at equal distances along said end piece of said handle with predetermined positions. Said central handle(10) is inserted into a long infundibuliform main body(20) with two ends open. One end is head end(21) and the other is tail end(25). On the inner part of said head end(21) is formed a female screw-threaded track(211). The outside diameter of said tail end is slightly larger than the outside diameter of said central handle(10), thus said central handle can be easily inserted into said main body. Located at a set position on the inner part of said tail end(25) are several rectangular slots(24) which correspond with said shallow recesses(13) of said central handle(10). The retaining collar(50) is a ring-shaped body, having an inner circular portion(52) and an outer circular portion(51). At equal intervals along the circumference of said retaining collar are axially oriented protrusions(53) on both inner and outer surfaces of said retaining collar(50). Said protrusions(53) snap fit into corresponding shallow recesses(13) in said central handle(10) and rectangular slots(24) in said main body(20). This action locks said central handle(10) and said main body(20) into a fixed relative position. Between said rectangular slots(24) and said tail end of said main body, there is a gradual linear taper(251). This ensures a space between said main body and said central handle. This serves to isolate said central handle from shock in the main body when it strikes a ball. Located at a fixed position on the inner surface of said main body is a cylindrical recess(22) which has small recesses(23) further provided, at equal distances. The outer surface(31) of an elastic ring(30) mates with said cylindrical recess (22) when said elastic ring(30) is slid into position. There are small protrusions(33) set at equal intervals along both internal and external circumferences of outer surfaces(31). Small protrusions(33) along outer circumferences snap fit corresponding into said small recesses(23) of said main body(20), and small protrusions(33) along the inner circumference snap fit into corresponding said rectangular recesses(12) in said central handle(10). The elastic ring(30) serves to hold in place said main body(20) and said central handle(10).

The end piece(40) is a hollow, hemispherical body. On the open side of the hemisphere is a cylindrical sleeve, of smaller diameter that the hemisphere, with male screw thread(41). This is screwed into said female threaded track(211) in said head end (21). On the inner bottom of said end piece(40) is an appendage(42) with hole(421). Said hole(421) attaches to hook(61) on one end of elastic connector(60). On the other end of said elastic connector (60) is an integral male threaded screw recess plug(62) which is screwed into female-threaded screw recess(14) in the end of said central handle.

It was stated that the present invention has dual functions of reducing the shock transmitted to the batter and of increasing the impulse imparted to the ball, when a ball is struck. The following is a detailed explanation of the principles by which this effect is attained.

Figure 3:
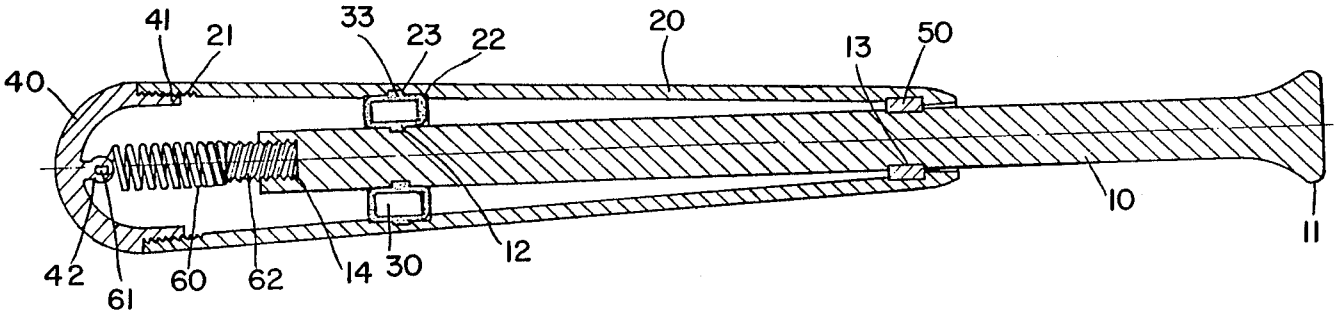
FIG. 3 is a sectional view taken on the line 3—3 of FIG. 2.
Figure 4:
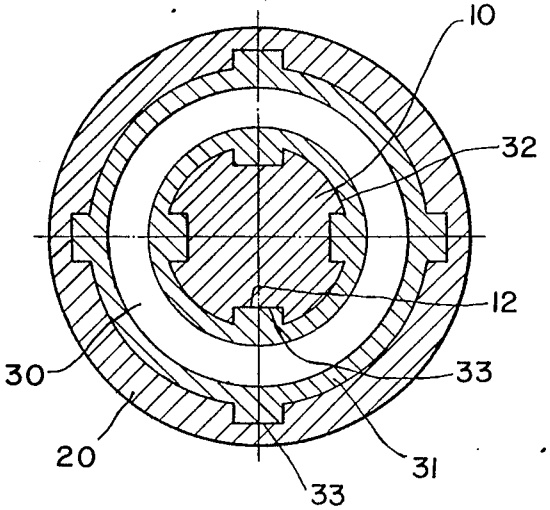
FIG. 4 is a sectional view taken on the line 4—4 of FIG. 2.

Please refer to FIG. 3. Said central handle(10) and main body (20) are separated components held together along a mutual axis by said retaining collar(50) and said elastic connector(60). When a ball is struck, said elastic ring(30) is compressed. The axis of said central handle(10) forces an angle with the axis of said main body(20) and said elastic connector(60) is elongated and pulled to one side. These actions restrict the shock of impact to said main body(20), away from said central handle(10). This reduction of shock said central handle(10) and hence to the batter's arm reduces the possibility of injury to the batter's elbow.

The elongated elastic connector(60) and compressed elastic ring(30) very quickly resume their original shape and orientation. This rebounding action imparts an impulse to the ball, thus the ball with leave the bat with a greater velocity. Moreover, a gas bladder can be placed inside of said elastic ring(30) to give a pneumatic spring effect. This will increase the elasticity of said elastic ring(30), thus increasing further the present invention's shock absorbing and impulse increasing properties. The present invention eliminates the deficiencies of conventional bats.

We claim:

1. A shock absorbing bat comprising:

a main body having a tail end and a head end and an end piece;

a central handle inserted into said main body from said tail end;

an elastic ring set in between said main body and said central handle circumferentially; and an elastic connector having a first end connected to said end piece and a second end connected to an end of said central handle inserted into said main body;

said main body and said central handle being held firmly together by means of said elastic ring and said elastic connector;

said elastic ring includes a gas bladder means for providing a pneumatic spring effect to increase the elasticity, thus increasing shock absorbing and impulse increasing properties of the bat.

2. A shock absorbing bat as claimed in claim 1, wherein said elastic connector connecting said end piece with said central handle is a spring.

3. A shock absorbing bat as claimed in claim 1, wherein a retaining collar provided between the tail end of said main body and said central handle circumferentially; said retaining collar being a ring-shaped body, having an inner circular portion and an outer circular portion, and said retaining collar being set firmly in said main body by means of cylindrical recesses provided in said tail end of said main body and said central handle.

4. A shock absorbing bat as claimed in claim 1, wherein the end of said central handle, which is inserted into said main body, is provided with a female threaded screw recess means for connecting said handle with a first end of said elastic connector, and a second end of said elastic connector being connected to said end piece.

5. A shock absorbing bat as claimed in claim 1 or 4, wherein said elastic ring includes small protrusions set at equal intervals along both internal and external circumferences so as to help said elastic ring firmly set into said main body and said central handle.

6. A shock absorbing bat as claimed in claim 1, wherein said end piece is provided with male screw thread means while said head end of said main body is provided with a female thread track means for connecting said head end with said end piece.

7. A shock absorbing bat as claimed in claim 1, wherein the outer surface of said central handle includes rectangular recesses, said rectangular recesses cooperating with the small protrusions on the circumference of the inner portion of said elastic ring to set said elastic ring into the central handle.

8. A shock absorbing bat as claimed in claim 1, wherein a gradual linear taper of the tail end of said main body ensures a space between said main body and said central handle, for isolating said central handle from shock.

9. A shock absorbing bat comprising:

a main body having a tail end and a head end defining an end piece;

a central handle inserted into said main body from said tail end;

an elastic ring set in between and firmly against both said main body and said central handle circumferentially; and an elastic connector having a first end connected to said end piece and a second end connected to an end of said central handle inserted into said main body;

said main body and said central handle being held firmly together by means of said elastic ring and said elastic connector; said elastic connector connecting said end piece with said central handle is a spring.

10. A shock absorbing bat as claimed in claim 9, wherein a retaining collar is provided between the tail end of said main body and said central handle circumferentially; said retaining collar being a ring-shaped body, having an inner circular portion and an outer circular portion, and said retaining collar being set firmly in said main body by means of cylindrical recesses provided in said tail end of said main body and said central handle.

11. A shock absorbing bat as claimed in claim 9, wherein the end of said central handle, which is inserted into said main body, is provided with a female threaded screw recess means for connecting said handle with a first end of said elastic connector, and a second end of said elastic connector being connected to said end piece.

12. A shock absorbing bat as claimed in claim 9 or 10, wherein said elastic ring includes small protrusions set at equal intervals along both internal and external circumferences so as to help said elastic ring firmly set into said main body and said central handle.

13. A shock absorbing bat as claimed in claim 9, wherein said end piece is provided with male screw thread means while said head end of said main body is provided with a female thread track means for connecting said head end with said end piece.

14. A shock absorbing bat as claimed in claim 9, wherein the outer surface of said central handle includes rectangular recesses, said rectangular recesses cooperating with the small protrusions on the circumference of the inner portion of said elastic ring to set said elastic ring into the central handle.

15. A shock absorbing bat as claimed in claim 9, wherein a gradual linear taper of the tail end of said main body ensures a space between said main body and said central handle, for isolating said central handle from shock.

* * * * *